US006962024B1

(12) United States Patent
Miller et al.

(10) Patent No.: US 6,962,024 B1
(45) Date of Patent: Nov. 8, 2005

(54) LOCKING WINDOW HAVING A SWEEP LATCH

(75) Inventors: D. Keith Miller, Trinity, NC (US); Christopher R. Rogers, Winston-Salem, NC (US); Farrell Smith, Sophia, NC (US); Jeffrey T. Hughes, Winston-Salem, NC (US)

(73) Assignee: Hughes Supply Company of Thomasville, Inc., Thomasville, NC (US)

( * ) Notice: Subject to any disclaimer, the term of this patent is extended or adjusted under 35 U.S.C. 154(b) by 172 days.

(21) Appl. No.: 09/908,418

(22) Filed: Jul. 18, 2001

(51) Int. Cl.[7] ..... E05C 3/04
(52) U.S. Cl. ..... 49/449; 292/241
(58) Field of Search ..... 49/449; 292/346, 292/241, 240, DIG. 20, DIG. 47

(56) References Cited

U.S. PATENT DOCUMENTS

| | | | | | |
|---|---|---|---|---|---|
| 229,894 | A | * | 7/1880 | Kolb et al. | 292/67 |
| 907,525 | A | | 12/1908 | Rapson | |
| 1,950,311 | A | * | 3/1934 | Leghart | 49/164 |
| 3,125,923 | A | | 3/1964 | Hanneman | |
| 3,645,573 | A | | 2/1972 | Strang | |
| 4,036,039 | A | | 7/1977 | Nakanishi | |
| 4,061,370 | A | | 12/1977 | Hauber | |
| 4,093,285 | A | | 6/1978 | Fayle | |
| 4,095,829 | A | | 6/1978 | Von Klompenburg | |
| 4,135,773 | A | | 1/1979 | Van Remoortel | |
| D268,643 | S | | 4/1983 | Anderson | |
| 4,436,328 | A | * | 3/1984 | Chernosky | 292/241 |
| 4,578,903 | A | | 4/1986 | Simpson | |
| 4,736,972 | A | | 4/1988 | Mosch | |
| 4,763,497 | A | | 8/1988 | Nakai | |
| 4,790,579 | A | | 12/1988 | Maxwell et al. | |
| 4,801,164 | A | | 1/1989 | Mosch | |
| 4,813,725 | A | * | 3/1989 | Mosch | 292/241 |
| 4,818,000 | A | | 4/1989 | Bobrowski | |
| D302,651 | S | | 8/1989 | Mosch | |
| 4,961,286 | A | * | 10/1990 | Bezubic | 49/175 |
| 5,040,835 | A | | 8/1991 | Barker | |
| 5,060,993 | A | | 10/1991 | Maier | |
| 5,103,533 | A | | 4/1992 | Pettit et al. | |
| 5,161,839 | A | * | 11/1992 | Piltingsrud et al. | 292/241 |
| 5,219,195 | A | | 6/1993 | Lawrence | |
| 5,248,174 | A | | 9/1993 | Matz et al. | |
| 5,301,989 | A | | 4/1994 | Dallmann et al. | |
| 5,414,899 | A | | 5/1995 | Raetz | |
| 5,489,131 | A | | 2/1996 | Blom | |
| D369,741 | S | | 5/1996 | Harrison et al. | |
| 5,582,445 | A | * | 12/1996 | Olsen et al. | 292/241 |
| D380,957 | S | | 7/1997 | Evans et al. | |
| D382,191 | S | | 8/1997 | Plummer | |
| D386,384 | S | | 11/1997 | Rausch et al. | |
| 5,741,032 | A | | 4/1998 | Chaput | |
| 5,791,700 | A | * | 8/1998 | Biro | 292/36 |
| 5,839,767 | A | | 11/1998 | Piltingsrud | |
| D418,737 | S | | 1/2000 | Libby et al. | |
| 6,010,094 | A | | 1/2000 | Csik et al. | |
| 6,023,021 | A | * | 2/2000 | Matthews et al. | 174/66 |
| 6,068,306 | A | * | 5/2000 | Brautigam | 292/242 |
| 6,116,665 | A | * | 9/2000 | Subliskey | 292/241 |

(Continued)

OTHER PUBLICATIONS

Letter from Taylor Olson Adkins Sralla Elam, LLP signed by Tom Carr and 20 pages of attachments.

*Primary Examiner*—Gregory J. Strimbu
(74) *Attorney, Agent, or Firm*—MacCord Mason PLLC

(57) ABSTRACT

A window latch includes a sweep latch; a housing including a support wall; a non-compressible pivot fastener for attaching the sweep latch to the housing; and a detent for retaining the sweep latch in one of an open position and a locked position.

40 Claims, 5 Drawing Sheets

U.S. PATENT DOCUMENTS

D432,392 S 10/2000 Miller et al.
6,142,541 A * 11/2000 Rotondi ..... 292/241
D442,058 S 5/2001 Miller et al.
6,347,820 B2 2/2002 Subliskey
6,412,834 B1 7/2002 Waitai et al.
6,457,752 B1 10/2002 Miller et al.

* cited by examiner

LOCKING WINDOW HAVING A SWEEP LATCH

BACKGROUND OF THE INVENTION (1) Field of the Invention

The present invention relates generally to a locking window and, more particularly, to a window latch for such a window.

(2) Description of the Prior Art

Up to the end of World War II, most windows were constructed of wood. However, following the War, aluminum windows were initially constructed for low-end housing. Over time, the clear superiority of metal windows led to their use in many different types of housing. Similarly, vinyl windows were introduced in low-end housing in the beginning of the last decade. The use of vinyl windows has grown much more quickly than metal windows. In fact, the majority of windows are now constructed of vinyl.

During this time, locking windows have generally used metal latches similar to those that were initially used on wooden windows. Now, although vinyl windows are the predominant construction, there has still been a hesitancy to use plastic hardware. However, metal is much heavier than its corresponding plastic counterpart. Also, plastic retains its appearance when mishandled or otherwise misused which causes unacceptable chips to form on painted metal hardware. Also, in today's modern economy, window hardware may be made in another country. Accordingly, advantages of substantial weight savings and lower shipping costs have become even more important.

However, making a locking window having a plastic latch is more than a mere substitution of materials. Because plastic is generally more flexible than metal, attempts at constructing a window latch having a center mounted sweep latch have failed since there's not a sufficient amount of support across the center of the sweep to prevent bowing. The importance of bowing is primarily due to the requirement by most manufacturers that the sweep latch be able to maintain a static load of about 160 pounds. When a conventional center mounted sweep latch is formed from plastic materials, the bowing of the sweep latch is so substantial that the static load will actually slide off the latch arm. Because of this problem, such window latches have not been able to pass the static load test.

Thus, there remains a need for a new and improved locking window having a window latch which may be completely formed from chip resistant plastics while, at the same time, still provides sufficient strength due to its arrangement to resist normal wear and tear during assembly and use.

SUMMARY OF THE INVENTION

The present invention is directed to a locking window having a window frame including at least one window sash that is selectively movable between a first closed position and a second open position, and a window latch. The window latch is adapted to be attached to the window and is selectively movable between a first open position and a second locked position to secure the window sash in the closed position. The window latch includes a sweep latch, a housing including a support wall, a non-compressible pivot fastener for attaching the sweep latch to the housing, and a detent for retaining the sweep latch in one of the open and the locked positions. Preferably, the detent provides an audible indication of the sweep latch being in one of the open and the locked positions. To accomplish this, the detent includes at least one protrusion on one of the housing and the sweep latch and a receiving groove on the other of the housing and the sweep latch, the protrusion and the groove being substantially parallel to the axis of the pivot fastener.

The sweep latch includes an actuator arm, a locking arm and a pivot point location between the actuator arm and the locking arm. Preferably, the sweep latch includes a finger tab on the actuator arm. A distal end of the locking arm is inclined to provide a mechanical advantage when the window latch is operated. A ratio of the length of the actuator arm to the length of the locking arm is greater than about 2 to provide a mechanical advantage when the window latch is operated.

The pivot fastener includes a support bushing and a fastener extending through the support bushing for attaching the sweep latch to the housing. Preferably, the fastener is a self-tapping threaded fastener. A collar extends at the pivot point location and along at least a portion of the non-compressible pivot fastener. A collar further may include gripping teeth and, preferably, mating gripping teeth.

A housing may extend beyond the pivot fastener parallel to the window frame in which case it may include an aperture for receiving a fastener for attaching the housing to the window. Preferably, the aperture for receiving a fastener for attaching the housing to the window includes a retainer for receiving a fastener. The base of the aperture for receiving a fastener may include a cavity for receiving shavings formed by attaching the window latch to the window.

Also, the housing may extend beyond the pivot fastener parallel to the window frame to include a finger shoulder for providing access to the sweep latch.

In a preferred embodiment, the housing includes a second support wall opposed to the support wall. Preferably, the support wall and the second opposed support wall are offset with respect to each other.

The base of the support bushing extends outward from the housing to form a load distributing surface and the distal end of the support bushing extends above the surface of the sweep latch to allow the sweep latch to move freely about the pivot fastener.

Accordingly, one aspect of the present invention is to provide a locking window. The locking window includes a window frame having at least one window sash that is selectively movable between a first closed position and a second open position, and a window latch. The window latch is adapted to be attached to the window and is selectively movable between a first open position and a second locked position to secure the window sash in the closed position. The window latch includes a sweep latch, a housing, and a non-compressible pivot fastener for attaching the sweep latch to the housing.

Another aspect of the present invention is to provide a window latch for a locking window. The window has a window frame including at least one window sash that is selectively movable between a first closed position and a second open position. The window latch includes a sweep latch, a housing including a support wall, and a non-compressible pivot fastener for attaching the sweep latch to the housing. The sweep latch is selectively movable between a first open position and a second locked position to secure the window sash in the closed position.

Still another aspect of the present invention is a locking window having a window frame including at least one window sash that is selectively movable between a first closed position and a second open position, and a window latch. The window latch is adapted to be attached to the window and is selectively movable between a first open position and a second locked position to secure the window sash in the closed position. The window latch includes a sweep latch, a housing including a support wall, a non-compressible pivot fastener for attaching the sweep latch to the housing, and a detent for retaining the sweep latch in one of the open and the locked positions. The sweep latch is selectively movable between a first open position and a second locked position to secure the window sash in the closed position.

These and other aspects of the present invention will become apparent to those skilled in the art after a reading of the following description of the preferred embodiment, when considered with the drawings.

DESCRIPTION OF THE PREFERRED EMBODIMENTS

Figure 1:
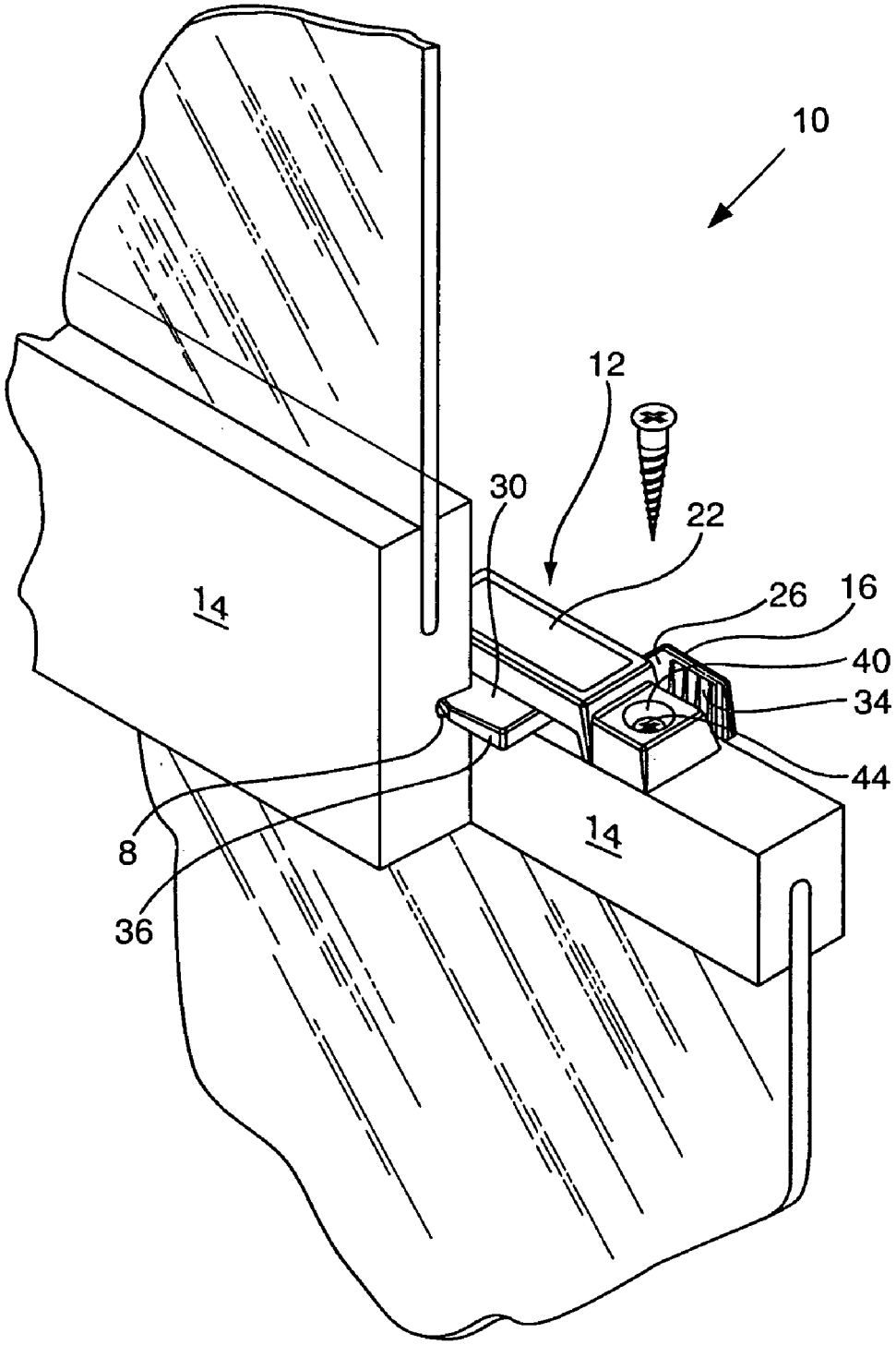
FIG. 1 is a perspective view of a locking window constructed according to the present intention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. A perspective view of the window locking system 10 is shown in FIG. 1. The window latch 12 is fastened to the frame 14 of the window and includes a housing 22 and a sweep latch 16. The sweep latch 16 includes an actuator arm 26, a finger tab 34, and a locking arm 30. The housing includes a finger shoulder 42 for providing access to the sweep latch.

The window 10 is locked by pivotally moving the actuator arm 26 inward toward the housing 22, causing the locking arm 30 to pivotally move away from the housing 22 and engage a groove 8, located in the frame 14 of the window 10. The locking arm 30 disengages the groove 8 and unlocks the window 10 when the actuator arm 26 pivotally moves away from the housing 22.

Figure 2:
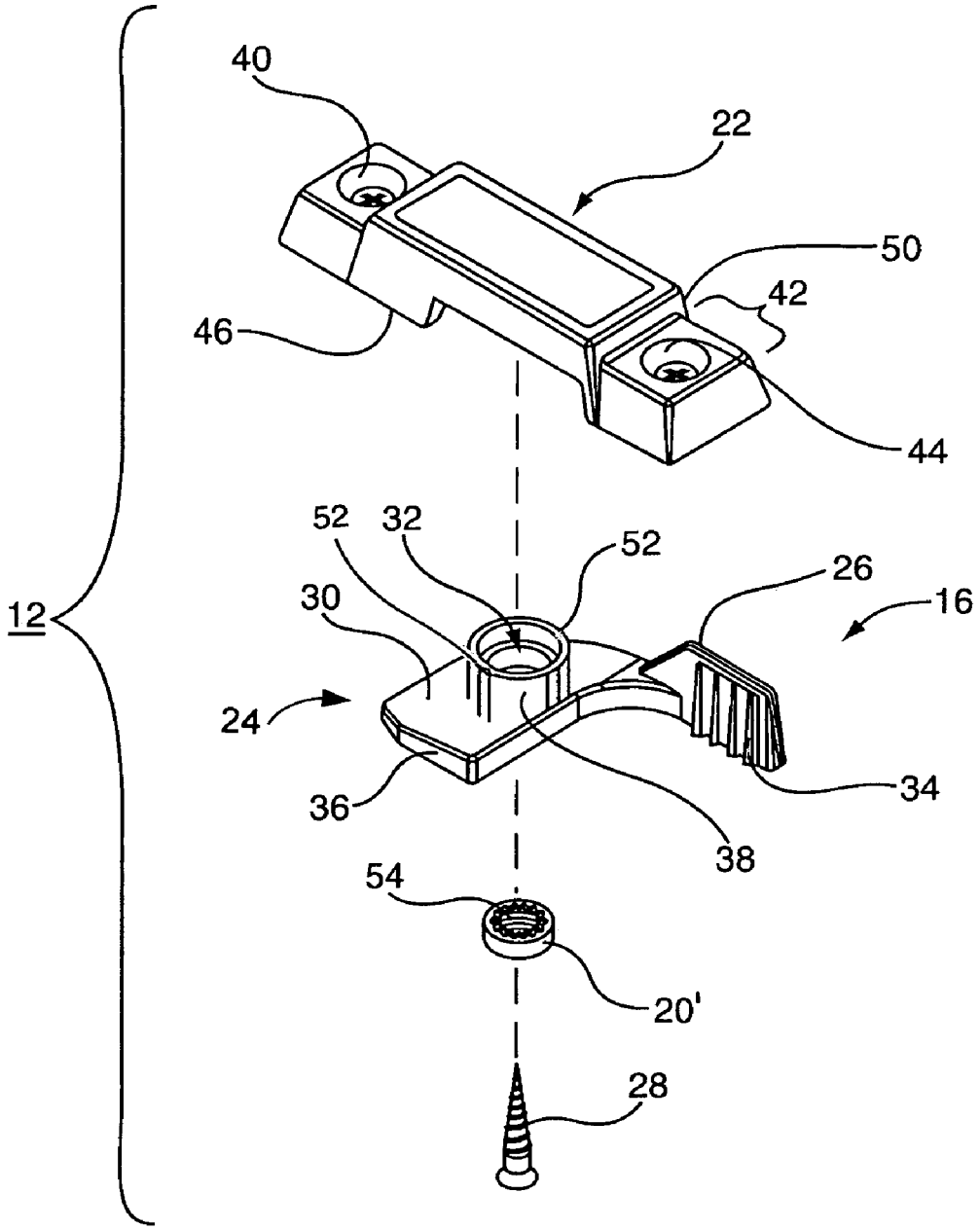
FIG. 2 is an isometric top exploded view of the window latch of the locking window shown in a closed position.
Figure 3:
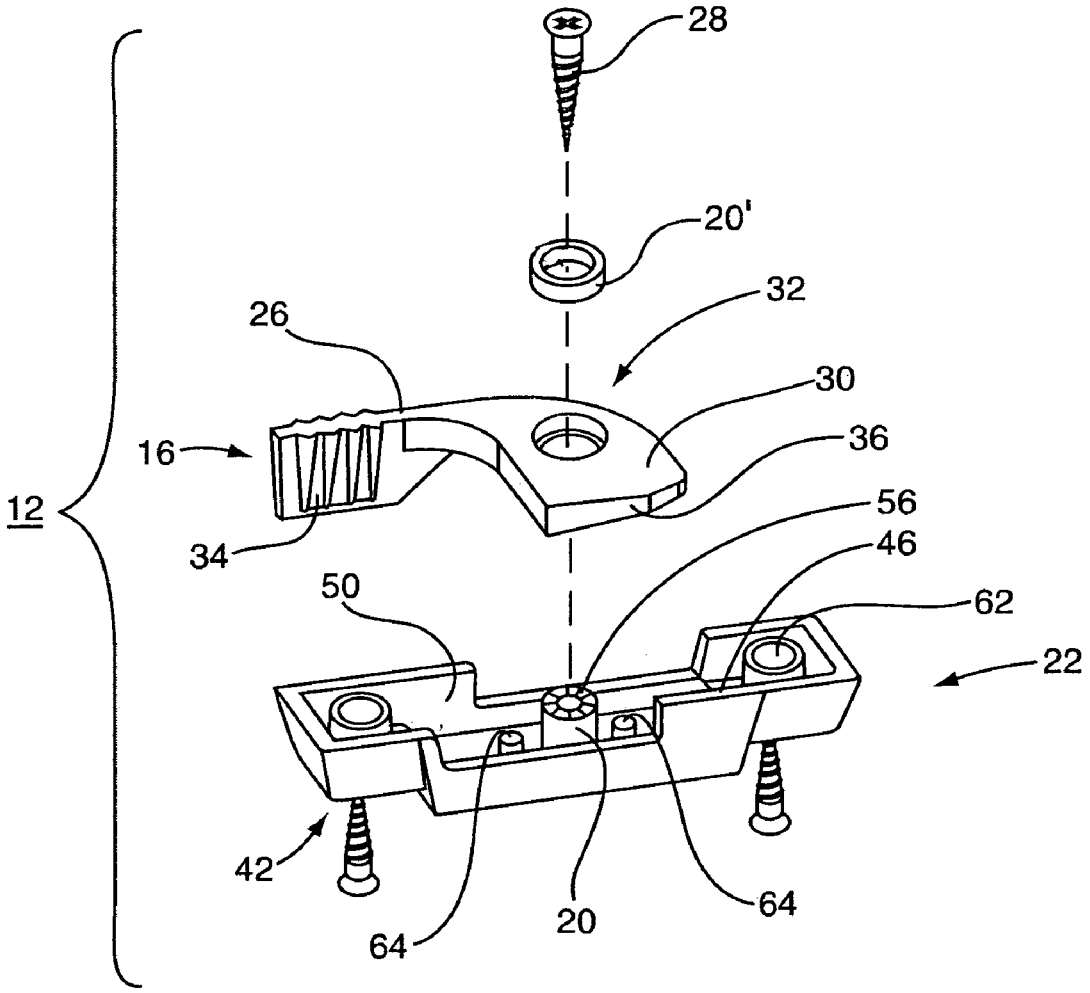
FIG. 3 is an isometric bottom exploded view of the window latch of the locking window shown in a closed position.

As best seen in FIGS. 1, 2, and 3, in the locked position, the locking arm 30 protrudes beyond the face of the window latch 12 and extends into the groove 8 within the frame 14 of the window 10, while the actuator arm 26 is withdrawn into the housing 22 of the window latch 12 so as to be flush with the outer surface of the housing 22. In the open position, the locking arm 30 is withdrawn from the groove 8 and concealed within the housing 22 of the window latch 12, while at the same time, the actuator arm 26 of the sweep latch 16 is fully extended substantially perpendicularly outward beyond the outer face of the housing 22 of the window latch 12.

As previously mentioned, the sweep latch 16 includes an actuator arm 26 and a locking arm 30. The sweep latch 16 pivots about a pivot point 32, and has two arms: the actuator arm 26 and the locking arm 30. The sweep latch 16 has an aperture at the pivot point 32 to accommodate a support busing 20' and a bushing 20. The length of the actuator arm 26 is approximately twice the length of the locking arm 30, thereby providing a mechanical advantage in opening and locking the window 10. As seen in FIGS. 2, 3, 5A and 5B, the locking arm 30 may also include an inclined face 36 to better facilitate insertion of the locking arm 30 into the groove 8 of the window 10.

Figure 5A:
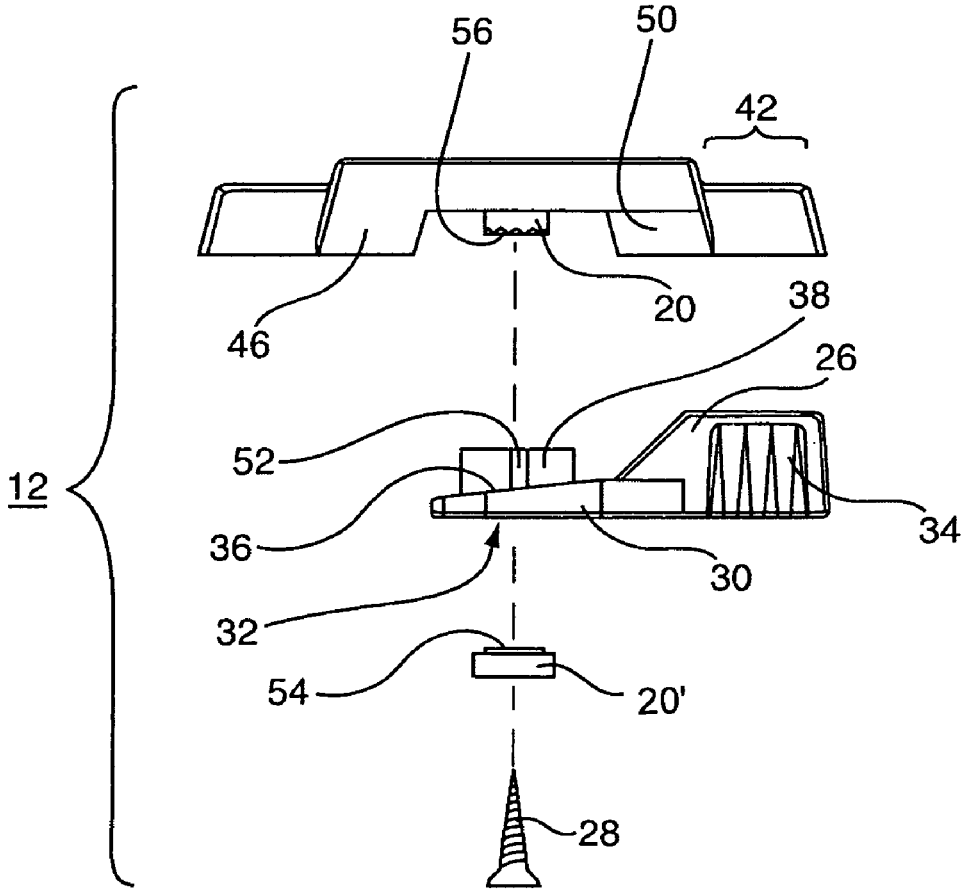
FIG. 5A is a back exploded view of the window latch shown in a closed position.

The non-compressible support bushing 20' is shown in an isometric bottom exploded view in FIG. 3, and front view in FIG. 5A. The non-compressible support bushing 20' allows the sweep latch 16 to pivot freely about the pivot point 32 while the window latch 12 is affixed to the window frame 14, and includes a bushing 20 and a corresponding support bushing 20' having a central aperture that allows a fastener 28 to pass therethrough. The support bushing 20' has a lower load-bearing surface 60, as seen in the bottom view of FIGS. 3 and 5B. The support busing 20' also includes a distal end that extends below the sweep latch 16. The distal end prevents compression of the sweep latch 16 by the housing 22 when the window latch 12 is affixed to the window frame 14.

In the preferred embodiment, the bushing 20 and support bushing 20' may include gripping teeth 56 and matching gripping teeth 56. The gripping teeth 56 enable the support busing 20' to bite into the bushing 20 thereby securely fixing its position to prevent its rotation as the sweep latch 16 is moved from the closed position to the opened position. In this way, the fastener 28 remains stationary as the sweep latch 16 is moved from the closed position to the opened position. In the preferred embodiment, the fastener 28 may be any threaded fastener, such as a screw. For a screw it is particularly beneficial that it remain stationary so that sweep latch 16 remains affixed to the housing 22.

A housing 22 having at least a single aperture 40 partially encloses both the sweep latch 16 and non-compressible support bushing 20' and bushing 20, protecting them from debris that may be generated during construction or installation of the window frame 14. The aperture 40 serves as a first attachment point and, in the preferred embodiment, the housing 22 includes a second aperture which serves as a second attachment point for the window latch 12.

Figure 4A:
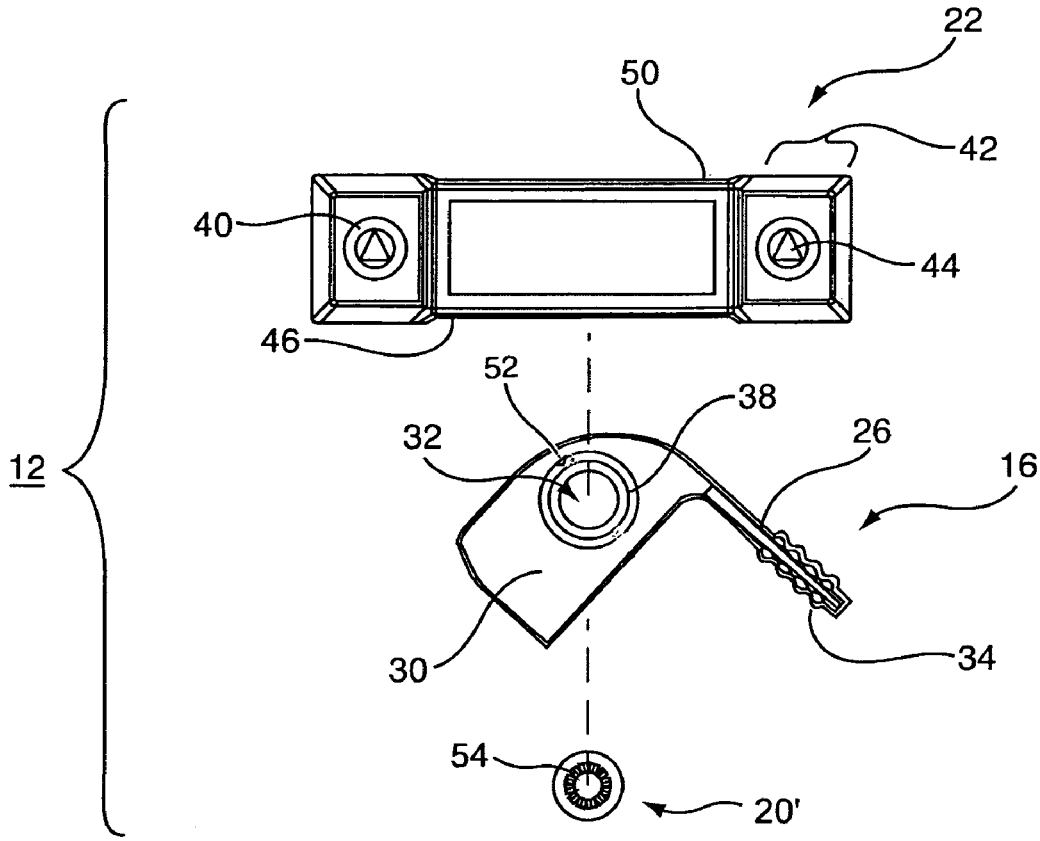
FIG. 4A is a top exploded view of the window latch shown in a partially open position.
Figure 4B:
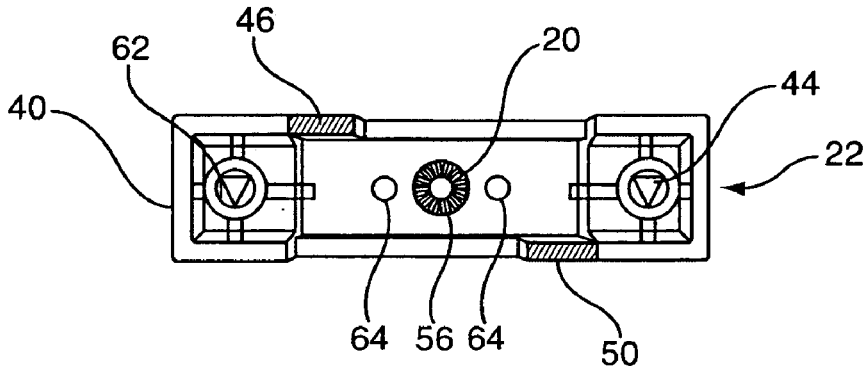
FIG. 4B is a bottom view of the housing of the window latch.
Figure 5B:
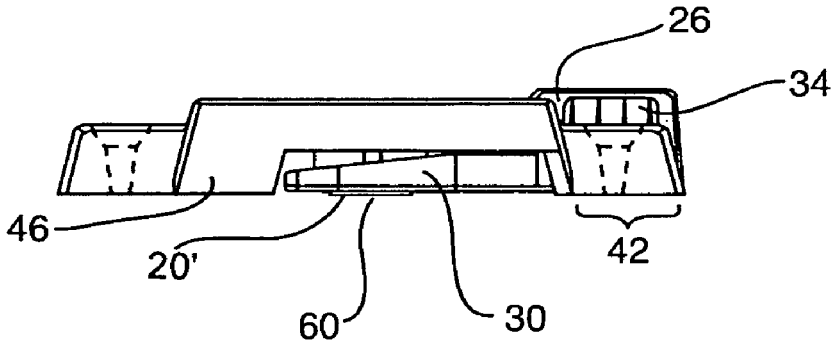
FIG. 5B is a front view of the window latch shown in a closed position.

As can be seen in FIGS. 2, 3, 4B, 5A and 5B, housing 22 includes a support wall 46 that allows it to be made of materials that may not be as stiff as steel, aluminum, brass and other materials that have been traditionally used in this application. As can be seen in FIGS. 3, 4B and 5A, housing 22 may further include a second support wall 50. As depicted, the second support wall 50 is opposed to the support wall 46. As can be seen in FIG. 5B, support wall 46, support bushing 20, and second support wall 50 can provide support to the central portion of housing 22 while accommodating the free movement of sweep latch 16 about pivot point 32.

Each aperture 40 may further include an internal retainer 44, which may be a small piece of plastic molded into the aperture 40 that allows a fastener to be temporarily secured in each aperture 40 for packaging purposes or shipping purposes and to prevent loss or to facilitate quick and efficient window assembly. Expediting the rapid assembly of window frames in a manufacturing environment is a further advantage of an internal retainer 44.

Each aperture 40 may further include a cavity 62 in its bottom surface to accommodate shavings generated when the window latch 12 is affixed to the window frame 14, or to accommodate any pull-up of the window frame 14 during attachment of the window latch 12 to the window frame 14.

Window latch 12 may also include a detent 24 that limits the range of movement of the sweep latch 16. The detent 24 includes at least one groove 52 of the sweep latch 16. In the preferred embodiment, the detent 24 includes pairs of grooves. At least one groove 52 of the detent 24 cooperates with a corresponding protrusion 64 located on the underside or bottom surface of housing 22. In the preferred embodiment, the protrusions 64 are located proximate to the pivot point 32 of the sweep latch 16. Also in the preferred embodiment, two protrusions 64 on the underside or bottom surface of housing 22 mate with two grooves 52 of the detent 24 located on the collar 38 of the sweep latch 16.

As the sweep latch 16 moves along its range of motion, the protrusions 64 travel along and in the collar 38 until one of the grooves is reached. At this point, the protrusion 64 enters a groove 52, producing an audible snap. The audible snap assists the user in determining whether the window latch 12 is in a fully engaged or fully disengaged position.

The window latch 12 may be formed from any lightweight durable material, such as a lightweight metal including aluminum, or a polymeric material. Applicants contemplate that suitable materials may be characterized by at least one of high strength, high rigidity, very good impact resistance, good elastic properties, dimensional stability, low tendency to creep, and simple processing. Preferably, suitable materials may be characterized by a plurality of the above. Applicants have found that among polymeric materials, polyamides (also known as nylons) and particularly polyamides including a filler to work well. In the preferred embodiment, the material used to form the window latch 12 was a polyamide material such as semi-crystalline Nylon 6 (PA6) containing about 30 percent glass fiber, manufactured by Hughes Supply & Manufacturing Company of Thomasville, Inc. of Thomasville, N.C. under the trademark "FIBERTRON™" material and having the properties presented below.

FIBERTRON ™ MATERIAL
Description: Semi-crystalline Nylon 6 (PA6)
Filler System: 33% Glass Fiber
Characteristics: Near Prime

| PROPERTY | UNITS | TYPICAL VALUES | STANDARD |
|---|---|---|---|
| | | General | |
| Density | g/cm3 | 1.42 | ASTM D792 |
| Melt Flow Index | g/10 min. | — | ASTM D1238 |
| Water Absorption | % | — | ASTM D570 |
| Mold Shrinkage | in/in | 0.002–0.004 | ASTM D955 |
| | | Mechanical | |
| Tensile Strength (break) | psi | 19,500 | ASTM D638 |
| Elongation (break) | % | 3.2 | ASTM D638 |
| Flexural Strength (yield) | psi | 29,750 | ASTM D790 |
| Flexural Modulus | psi | 1,250,000 | ASTM D790 |
| Impact Strength (Izod-notched) | ft-lb/in | 3.3 | ASTM D256 |

-continued

FIBERTRON ™ MATERIAL
Description: Semi-crystalline Nylon 6 (PA6)
Filler System: 33% Glass Fiber
Characteristics: Near Prime

| PROPERTY | UNITS | TYPICAL VALUES | STANDARD |
|---|---|---|---|
| | | Thermal | |
| Heat Deflection Temperature (264 psi) | F. | — | ASTM D648 |
| Vicat Softening Temperature | F. | — | ASTM D1525 |
| | | Flammability | |
| UL Flammability Rating | Class | — | UL 94 |

The "FIBERTRON™" material may be made using commercially available polyamides such as the "ULTRAMID®" polyamide sold by BASF Corporation of Mount Olive, N.J. These ULTRAMID®" polyamide materials, their applications, properties and processing as described in a publication by BASF Plastics entitled "ULTRAMID®" Polyamides, the subject mater of which is incorporated in its entirety herein by reference.

A locking window and window latch constructed according to the present invention, may be completely formed from chip resistant plastics while, at the same time, still provides sufficient strength due to its offset arrangement to resist normal wear and tear during assembly and use.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A locking window, said locking window comprising:

(a) at least one window sash which is selectively movable between a first closed position and a second open position; and (b) a window latch adapted to be attached to said locking window and that is selectively movable between a first open position and a second locked position to secure said window sash in said closed position, said window latch including a pivoting sweep latch having a locking arm that is movable to engage a receiving groove within said locking window, a housing and a fastener for attaching said sweep latch to said housing and a non-compressible bushing coaxially aligned with said fastener and extending into said sweep latch for preventing compression of said sweep latch by said housing by extending below said sweep latch while allowing said sweep latch to pivot thereabout.

2. The locking window according to claim 1, further including a detent for retaining said window latch in one of said first open and said second locked positions.

3. The locking window according to claim 2, wherein said detent provides an audible indication of said window latch in one of said open and said locked positions.

4. The locking window according to claim 2, wherein said detent comprises at least one protrusion on one of said housing and said sweep latch and a detent groove on the other of said housing and said sweep latch, said protrusion and said detent groove being substantially parallel to an axis of said fastener.

5. A window latch for a locking window, said window latch comprising:

(a) a sweep latch having a pivoting locking arm that is moveable to engage a receiving groove within said locking window;

(b) a housing including a support wall for supporting a central portion of said housing; and (c) a fastener for attaching said sweep latch to said housing and a non-compressible bushing coaxially aligned with said fastener and extending into said sweep latch for preventing compression of said sweep latch by said housing by extending below said sweep latch while allowing said sweep lath to pivot thereabout, wherein said sweep latch is selectively movable between a first open position and a second locked position for securing a window in a closed position.

6. The window latch according to claim 5, wherein said sweep latch includes an actuator arm, and a pivot point location between said actuator arm and said locking arm.

7. The window latch according to claim 6, further including a finger tab on said actuator arm.

8. The window latch according to claim 6, wherein a distal end of said locking arm is inclined to provide a mechanical advantage when said window latch is operated.

9. The window latch according to claim 6, wherein a ratio of the length of said actuator arm to the length of said locking arm is greater than about 2 to provide a mechanical advantage when said window latch is operated.

10. The window latch according to claim 6, further including gripping teeth.

11. The window latch according to claim 10, further including mating teeth that compliment said gripping teeth.

12. The window latch according to claim 6, further including a collar extending at said pivot point location and along at least a portion of said fastener.

13. The window latch according to claim 5, wherein said fastener extends through said support bushing for attaching said sweep latch to said housing.

14. The window latch according to claim 13, wherein said fastener is a self-tapping threaded fastener.

15. The window latch according to claim 5, wherein said housing extends beyond said fastener parallel to said window and includes an aperture for attaching said housing to said window.

16. The window latch according to claim 15, wherein said aperture includes a retainer.

17. The window latch according to claim 5, wherein the housing includes a cavity for receiving shavings formed by attaching said window latch to said window.

18. The window latch according to claim 5, wherein said housing extends beyond said fastener parallel to said window to include a finger shoulder for providing access to said sweep latch.

19. The window latch according to claim 5, further including a second support wall opposed to said support wall.

20. The window latch according to claim 19, wherein said support wall and said second opposed support wall are offset with respect to each other.

21. The window latch according to claim 5, wherein one end base of said bushing forms a load distributing surface.

22. A locking window, said locking window comprising:

(a) at least one window sash which is selectively movable between a first closed position and a second open position; and (b) a window latch adapted to be attached to said locking window and to secure said window sash in said closed position, a window latch comprising:

(i) a pivoting sweep latch having a locking arm that is moveable to engage a receiving groove within said locking window;

(ii) a housing including a support wall for supporting a central portion of said housing;

(iii) fastener for attaching said sweep latch to said housing and a non-compressible bushing coaxially aligned with said fastener and extending into said sweep latch for preventing compression of said sweep latch by extending below said sweep latch while allowing said sweep latch to pivot thereabout; and (iv) a detent for retaining said sweep latch in one of sweep latch is selectively said first open position and said second locked position for securing said window sash in said closed position.

23. The locking window according to claim 22, wherein said detent provides an audible indication of said sweep latch being in one of said first open and said second locked positions.

24. The locking window according to claim 22, wherein said detent includes at least one protrusion on one of said housing and said sweep latch and a detent groove on the other of said housing and said sweep latch, said protrusion and said groove being substantially parallel to an axis of said detent fastener.

25. The locking window according to claim 22, wherein said sweep latch includes an actuator arm, and a pivot point location between said actuator arm and said locking arm.

26. The locking window according to claim 25, further including a finger tab on said actuator arm.

27. The locking window according to claim 25, wherein a distal end of said locking arm is inclined to provide a mechanical advantage when said window latch is operated.

28. The locking window according to claim 25, wherein a ratio of the length of said actuator arm to the length of said locking arm is greater than about 2 to provide a mechanical advantage when said window latch is operated.

29. The locking window according to claim 25, further including a collar extending at said pivot point location and along at least a portion of said fastener.

30. The locking window according to claim 25, further including gripping teeth.

31. The locking window according to claim 30, further including mating teeth that compliment said gripping teeth.

32. The locking window according to claim 22, wherein said fastener including a support bushing and a fastener extending through said support bushing for attaching said sweep latch to said housing.

33. The locking window according to claim 32, wherein said fastener is a self-tapping threaded fastener.

34. The locking window according to claim 22, wherein said housing extends beyond said fastener parallel to said window sash and includes an aperture for receiving a fastener for attaching said housing to said window.

35. The locking window according to claim 34, wherein said aperture for receiving a fastener for attaching said housing to said window includes a retainer.

36. The locking window according to claim 22, wherein the housing includes a cavity for receiving shavings formed by attaching said window latch to said window.

37. The locking window according to claim 22, wherein said housing extends beyond said fastener parallel to said window sash to include a finger shoulder for providing access to said sweep latch.

38. The locking window according to claim 22, further including a second support wall opposed to said support wall.

39. The locking window according to claim 38, wherein said support wall and said second opposed support wall are offset with respect to each other.

40. The locking window according to claim 22, wherein one end of said bushing forms a load distributing surface.

* * * * *

UNITED STATES PATENT AND TRADEMARK OFFICE

CERTIFICATE OF CORRECTION

PATENT NO. : 6,962,024 B1
DATED : November 8, 2005
INVENTOR(S) : D. Keith Miller et al.

It is certified that error appears in the above-identified patent and that said Letters Patent is hereby corrected as shown below:

Column 3,
Line 47, delete “locking system”.

Column 4,
Line 11, “support busing 20’” should read -- support bushing 20’ --.
Line 27, “support busing” should read -- support bushing --.
Lines 33 and 34, should read -- gripping teeth 54 and matching gripping teeth 56 --.

Column 8,
Line 21, add -- a -- after “of”.
Line 22, delete “sweep latch is selectively said”.

Signed and Sealed this

Twenty-eighth Day of February, 2006

JON W. DUDAS
*Director of the United States Patent and Trademark Office*